United States Patent [19]

Brickhouse

[11] Patent Number: 4,716,602

[45] Date of Patent: Jan. 5, 1988

[54] URINATION DEFLECTOR

[76] Inventor: Todd Brickhouse, 8 Joan La., Massapequa Park, N.Y. 11762

[21] Appl. No.: 778,141

[22] Filed: Sep. 20, 1985

[51] Int. Cl.[4] ..... A47K 13/00

[52] U.S. Cl. ..... 4/237; 4/DIG. 5; 4/300.3

[58] Field of Search ..... 4/144.1-144.4, 4/300.3, 301, 307, 462, 237, 242, DIG. 5; 229/106, 190

[56] References Cited

U.S. PATENT DOCUMENTS

| | | | |
|---|---|---|---|
| 717,362 | 12/1902 | Donley | 229/106 |
| 1,879,066 | 9/1932 | Bryant | 4/237 |
| 2,100,774 | 11/1937 | Depuy et al. | 4/237 |
| 2,113,705 | 4/1938 | Merrett | 4/237 |
| 2,141,341 | 12/1938 | Bentz | 4/237 |
| 2,825,070 | 3/1958 | Alexander et al. | 4/DIG. 5 |
| 2,930,050 | 3/1960 | Dobreff | 4/DIG. 5 |
| 3,478,950 | 11/1969 | Stevens | 239/190 |
| 4,253,203 | 3/1981 | Thomas | 4/611 |
| 4,339,061 | 7/1982 | Dunn | 224/901 |

OTHER PUBLICATIONS

P. 191, Cleo Living Aids Catalogue, C-6175-Seat Reducer.

P. 139, Abbey Medical Catalogue, AM07-2033, AM 1802231, AM 18-2337, AM 18 2230, AM 18 3512, AM 18-3511 and AM-18-5031.

*Primary Examiner*—Henry J. Recla
*Assistant Examiner*—Linda J. Sholl
*Attorney, Agent, or Firm*—Brumbaugh, Graves, Donohue & Raymond

[57] ABSTRACT

A urination deflector for attachment to a toilet seat is formed using a sheet of flexible plastic material which is provided with hook and loop fastening arrangements which maintain the device to the toilet seat and provide for folding of the device into its functional configuration.

3 Claims, 3 Drawing Figures

URINATION DEFLECTOR

FIELD OF THE INVENTION

This invention relates to a product for use with a toilet bowl.

BACKGROUND OF THE INVENTION

Because of various infirmities some people, when urinating in a seated position, have difficulty in controlling the projection of the discharge with a consequent degree of messiness. The invention is directed to a solution of this problem. In particular, it provides apparatus which can be fastened to the toilet seat to contain the discharge to the toilet bowl.

To be practical, such apparatus needs to be relatively simple and easy to fasten and remove. it also should be of material which is essentially nonabsorbent.

SUMMARY OF THE INVENTION

The invention provides apparatus which solves the problem and which has the desired characteristics mentioned. In particular, the apparatus comprises a flexible sheet of a plastic material provided with cooperating central, side and top flexible portions, and fastening means easily closed and easily released for locking the sheet into its fixed functional position and for fastening the apparatus to the toilet seat, such that when the apparatus is locked into its functional position and fastened to the toilet seat it serves to confine urinary discharges to the toilet bowl.

DETAILED DESCRIPTION

Figure 1:
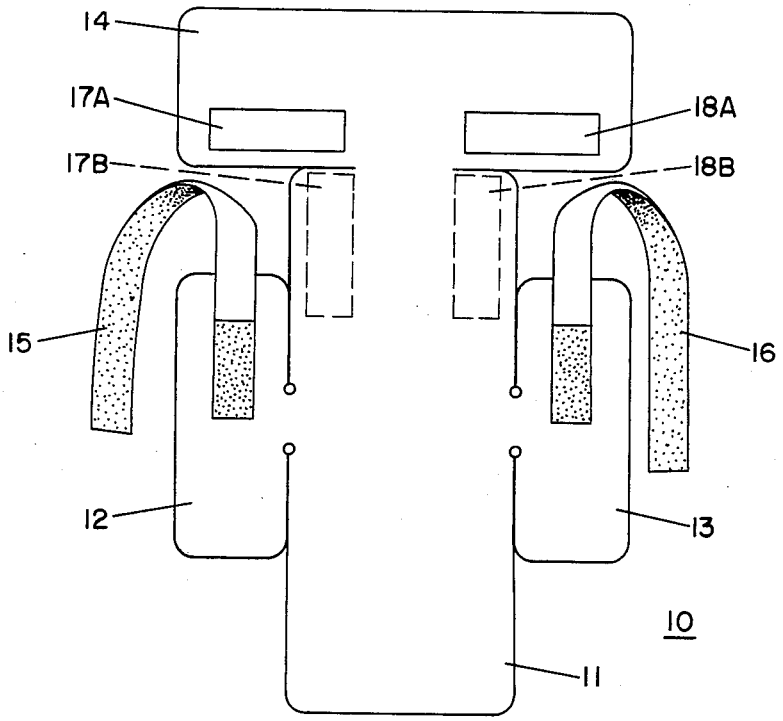
FIG. 1 is a plan view of a sheet forming the present invention, in its unflexed position.
Figure 2:
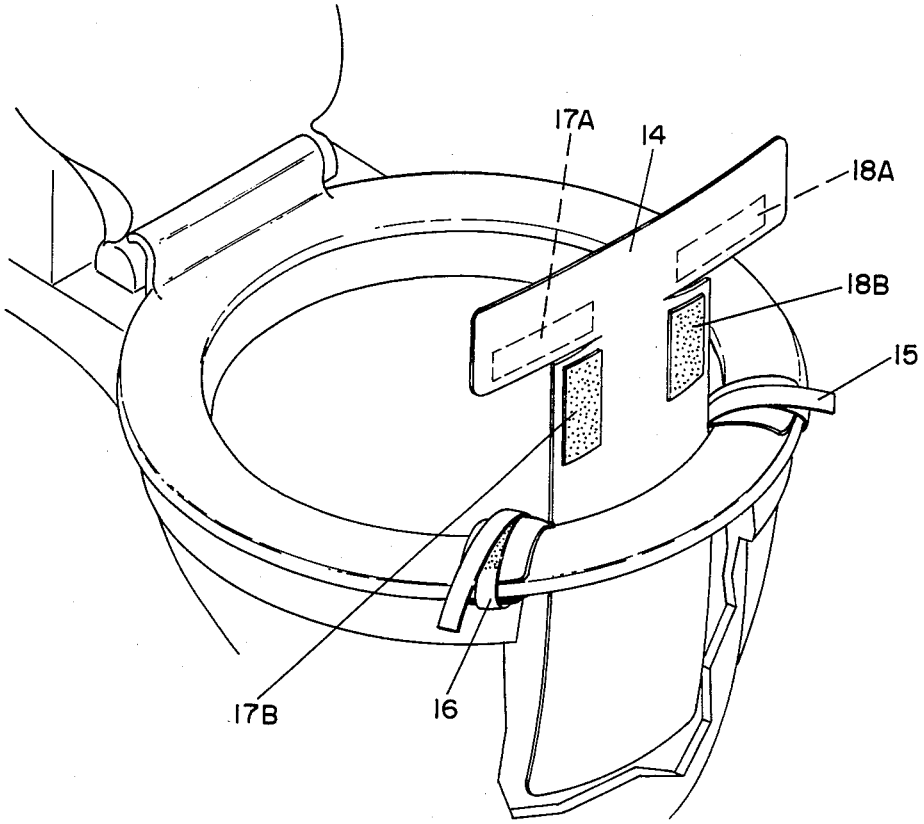
FIG. 2 shows the sheet of FIG. 1 in a partially flexed state fastened to a toilet seat.

FIG. 1 shows a planar sheet 10 of flexible material such as polystyrene of 1/16 inch thickness and the various fastening means associated therewith forming an embodiment of the invention. The sheet 10, includes a main central rectangular portion 11, smaller rectangular side portions 12 and 13 disposed on opposite sides of the central portion, and a relatively wider top rectangular portion 14. Slits (not numbered) are provided at each interface of the central portion with the various side and top portions to permit flexing of the side and top portions into non-planar positions. Fastening means are provided on each side portion to permit tying of the apparatus to a toilet seat as best seen in FIG. 2. The fastening means advantageously is of the known Velcro type including a hook portion and a loop portion which when pressed together lock to one another. As shown, each fastener strap 15, 16 includes a relatively short hook portion supported on the plastic sheet and a relatively longer strip designed to serve as the loop portion.

When the apparatus is attached to a toilet seat by the side portions as shown in FIG. 2, the central portion conforms to the curvature of the inner edge of the toilet seat and thereby assumes a cylndrical shape which provides vertical rigidity to the central portion.

The plastic sheet also includes provision for locking the sheet in its flexed functional position. To this end, another pair of Velcro-type fasteners are included. The top portion 14 of the sheet is provided with the separate loop portions 17A and 18A and the central portion 11 with separate hook portions 17B and 18B. As shown, hook portions 17A and 18A are on the top surface of the sheet and loop portions 17B and 18B on the underside of the sheet. Typical locations and sizes of the various fastener parts are shown essentially to scale in the drawing. For the dispositions described, for achieving the functional position, the top portion is flexed so that the regions of its top surface on which sit the loop portions 17A and 18A align with and contact the hook portions 17B and 18B of the central portion, as best seen in FIG. 3, and the sheet is thereby locked in this position.

Figure 3:
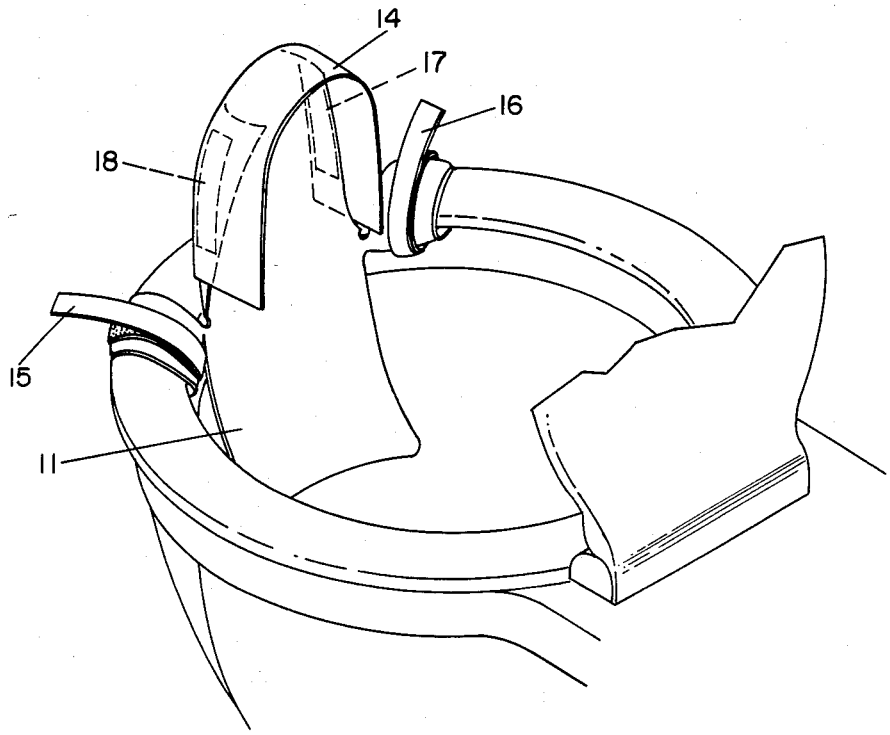
FIG. 3 shows the sheet of FIG. 1 flexed and locked to its functional position and fastened to the toilet seat ready for use.

As seen in FIG. 3, in its locked position, the sheet effectively serves to contain the toilet bowl discharges directed towards it, even if aimed upwards where they are deflected by the flexed top portion 14. To this end, the top portion forms a surface which is essentially one half of a cylinder, upwardly closed and downwardly open, the far end of which is closed by the abutting main central portion.

The engagement of the upper portion holds the central portion in its vertical cylindrical shape at its upper end.

Typical dimensions for the unflexed sheet are: for the central portion a height of 14" and a width of 6"; from the top portion a height of 4" and a width of 12", for each side portion a height of 7" and a width of 3". Of course these can be varied. Similarly it is feasible to use the other thicknesses and other materials for the sheet, but the plastic used has obvious advantages for cleaning. Also it is feasible to reverse the positions of the hook and loop portions of each fastener. In addition, for locking it is feasible to locate the fastener portions on the bottom surface of the top portion and the top surface of the central portion, in which case the top portion would be folded under the central portion rather than over it.

Prior to use the device may be affixed to the toilet seat as shown in FIG. 2. After the user has seated the device can be folded into the functional configuration of FIG. 3. Accordingly while the user is being seated (or unseated), the upper projecting portions of the device are relatively flexible to avoid injury.

It can be appreciated that an important advantage of the apparatus described in its ease of manufacture since it can be formed from a single sheet of plastic appropiately shaped, to which have been attached the fastener elements.

I claim:

1. Apparatus for being fastened to a toilet seat for containing urinary discharges to the associated tolet bowl comprising a relatively flexible sheet having top and bottom surfaces and which in its unflexed state comprises a main central portion, a pair of side portions and a top portion, the side portions and the top portion being adapted to be bent away from the plane of the main portion to form a flexed functional position, said side portions having upper and lower extensions arranged to wrap around the sides of a toilet seat and having separate flexible straps associated with each side portion for surroundig said side portion extensions and a portion of the toilet seat, thereby fastening the sheet to the toilet seat and forming said main central portion into a cylindrical surface, and a pair of hook and loop fastener sets, one half of each being supported on the top portion and one half on the main portion, so disposed that when the top portion is flexed to its functional position the separate halves are mated and the sheet is locked in its functional position.

2. The apparatus of claim 1 in which the half of each fastener on the top portion is on its top surface and the half of each fastener on the main portion is on its bottom surface and the top portion is folded over the main portion in its functional position.

3. The apparatus of claim 1 in which in the functional position the top portion forms essentially the surface of half of a cylinder upwardly closed and downwardly open, one of whose ends is closed by the main central portion.

* * * * *